US005945645A

United States Patent [19]

Makuc et al.

[11] Patent Number: 5,945,645

[45] Date of Patent: Aug. 31, 1999

[54] ACTIVATION DEVICE FOR AN ELECTRICAL APPLIANCE SUCH AS A CIRCUIT-BREAKER-MOTOR

[75] Inventors: Daniel Makuc, Longvic; Jacques Marcenne, Dijon, both of France

[73] Assignee: Schneider Electric SA, Boulogne Billancourt, France

[21] Appl. No.: 08/829,945

[22] Filed: Apr. 1, 1997

[30] Foreign Application Priority Data

Apr. 5, 1996 [FR] France ..... 96 04432

[51] Int. Cl.[6] ..... H01H 13/68

[52] U.S. Cl. ..... 200/5 E; 200/43.18; 200/50.32; 200/518

[58] Field of Search ..... 200/1 R, 5 A–5 E, 200/16 R, 16 D, 1 B, 43.16, 43.18, 50.32, 518, 520, 329, 341; 307/326–328

[56] References Cited

U.S. PATENT DOCUMENTS

| | | | |
|---|---|---|---|
| 2,558,113 | 6/1951 | Walton | 74/483 |
| 2,579,168 | 12/1951 | Ballou | 175/307 |
| 2,897,327 | 7/1959 | De Smidt et al. | 200/168 |
| 3,188,411 | 6/1965 | Luenser | 200/50 |
| 3,591,745 | 7/1971 | Puetz | 200/153 |
| 4,514,601 | 4/1985 | Buchanan | 200/5 E |

FOREIGN PATENT DOCUMENTS

| | | |
|---|---|---|
| 0 559 507 | 9/1993 | European Pat. Off. . |
| 31 13 034 | 10/1982 | Germany . |
| 33 41 874 | 7/1984 | Germany . |
| 1079012 | 8/1967 | United Kingdom . |

*Primary Examiner*—Michael A. Friedhofer
*Attorney, Agent, or Firm*—Oblon, Spivak, McClelland, Maier & Neustadt, P.C.

[57] ABSTRACT

An activation device with a start button and an emergency stop button for an electric appliance such as a circuit breaker equipped with a start control device and a stop control device with alternating movements. Also included is a disengageable transmission device, preferably consisting of a toggle lever acted upon by a safety lever capable of detecting the position of the emergency stop button, is placed between the start button 14 and the start device specific to the circuit breaker. This arrangement prevents the circuit breaker from being started by forcing the start button even though the emergency stop button has been pressed and is locked in the stop position.

10 Claims, 2 Drawing Sheets

ACTIVATION DEVICE FOR AN ELECTRICAL APPLIANCE SUCH AS A CIRCUIT-BREAKER-MOTOR

BACKGROUND OF THE INVENTION

1. Field of the Invention

This invention relates to a manual activation device for an electrical switching appliance such as a circuit breaker-motor housed in a casing and equipped with a start control device and a stop control device with alternate movements.

2. Discussion of the Background

This type of control device is well known and includes a push type start button and a lockable emergency stop button, these buttons having parallel axes and being placed on one side of the casing, and working with the appliance start and stop devices respectively. It is observed that it is sometimes possible to put the circuit breaker-motor in the start condition by pressing strongly on the start button on the casing, even if the emergency stop button has been pressed in the stop position and is locked in this position. This maneuver is possible due to deformations and tolerances that occur during assembly.

SUMMARY OF THE INVENTION

The purpose of this invention is to overcome this disadvantage and make the start button inoperative when the emergency stop button is locked in the stop position.

According to the invention:

the start button is connected to the start device through a disengageable transmission device that may be in either a normal state in which a pulse applied to the start button is transmitted to the start device, or in a safety state in which the pulse is not transmitted, there is a safety mechanism between the emergency stop button and the stop device, that is controlled by the emergency stop button to put the transmission device into its safety state when the emergency stop button is pressed.

Therefore, the purpose is achieved by simple means, the trippable transmission device preferably being a fast trip device such as a fast toggle lever the elbow of which is in contact with a sliding surface provided on a lever, and also in contact with a stop that is retractable when the emergency stop button is pressed.

BRIEF DESCRIPTION OF THE DRAWINGS

The following description of a non-restrictive embodiment of the invention refers to the accompanying drawings, and illustrates the advantages and the results obtained using the invention.

DESCRIPTION OF THE PREFERRED EMBODIMENTS

Figure 1:
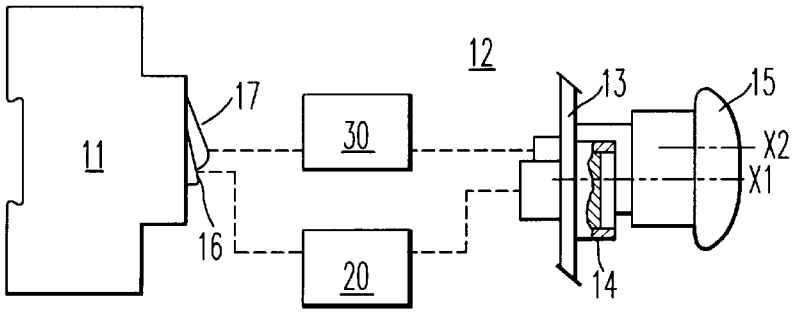
FIG. 1 diagrammatically shows a manual activation device for the circuit breaker-motor in accordance with the invention.

Referring now to the drawings, wherein like reference numerals designate identical or corresponding parts throughout the several views, and more particularly to FIG. 1 thereof, there is illustrated an activation device including a circuit breaker-motor 11 housed in a casing 12, the front surface 13 of which is fitted with push buttons with parallel axes X1 and X2, namely one push type start button 14 and a punch type emergency stop button 15, to activate a circuit breaker-motor 11 start control device 16 and stop control device 17, through transmission elements described later. Devices 16 and 17 are pressure activated toggle buttons like those described in document EP-559 507, but may also be of the sliding type; these devices are free to move into one of two positions by alternating movements, each being held in one of the two positions, in other words when the circuit breaker-motor is in the start state, the start device 16 is pressed in and the stop device 17 is out, whereas when the circuit breaker-motor is in the stop state, the start device 16 is out and the stop device 17 is pressed in.

According to the invention, the box start button 14 is connected to the circuit breaker-motor start device 16 through a trippable transmission device 20, preferably with sudden tripping; the transmission device 20 can take on a normal position on which the transmission can be activated on device 16 by pressing on button 14, or a safety position in which this transmission is inactive. Furthermore, between the emergency stop button 15 on the casing and the circuit breaker-motor stop device 17, there is a safety mechanism 30 that acts on the transmission device 20 to put it in a safety state when the emergency stop button is pressed in, in order to disactivate the transmission when an attempt is made to force start button 14.

Figure 2:
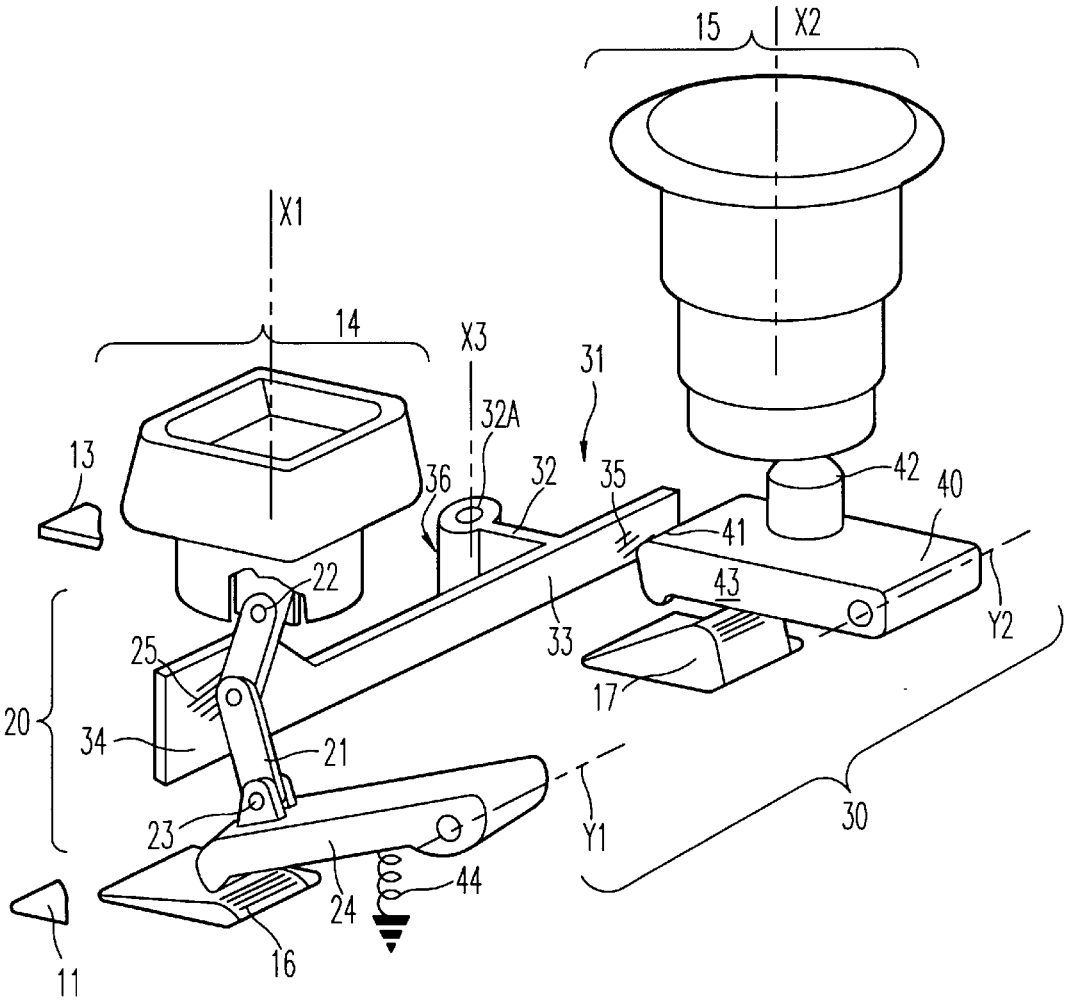
FIG. 2 shows a perspective view of the elements in the device in FIG. 1.
Figure 3:
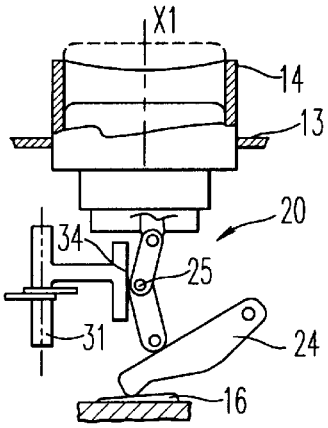
FIGS. 3 and 4 show a schematic section in elevation through the device at the start button and the emergency stop button respectively, in the circuit breaker-motor start position.
Figure 4:
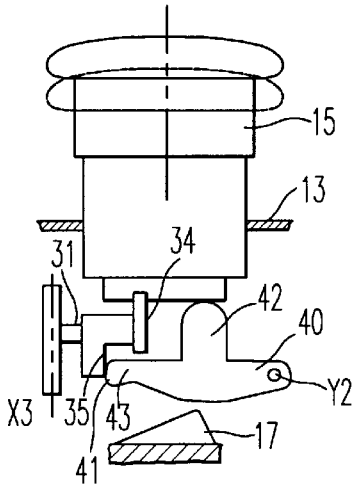
Figure 5:
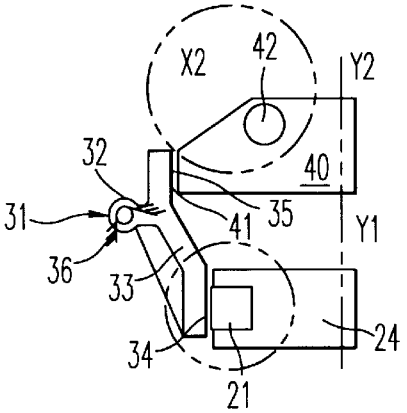
FIG. 5 shows a schematic top view of the device, in the same position.
Figure 6:
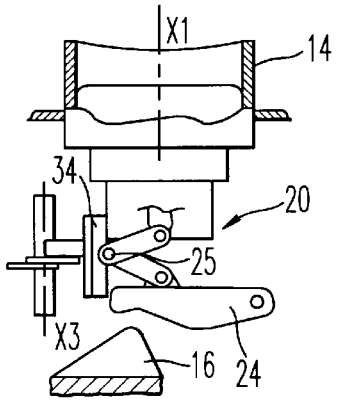
FIGS. 6 to 8 show the device in the circuit breaker stop position, with an attempt to activate the start button although the emergency stop button is locked, in views corresponding to the views in FIGS. 3 to 5.
Figure 7:
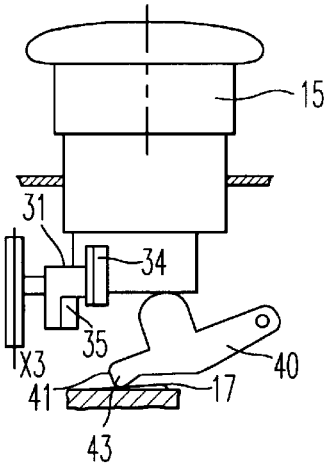
Figure 8:
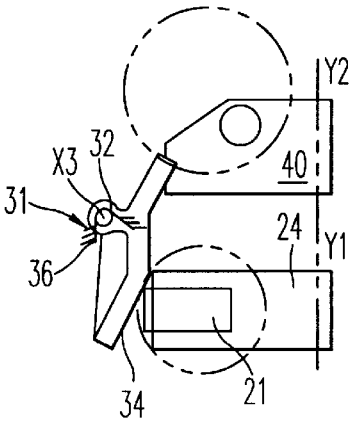

In this case and as shown in FIG. 2, the sudden trip transmission device 20 consists of a hinged toggle lever 21 cooperating at one end 22 with a mobile element of the start button 14 and at the other end 23, with a lever 24 that can be activated by pushing on the start device 16. The lever 24 may rotate about an axis Y1 orthogonal to the X1 and X2 axes. The toggle lever 21 elbow 25 is forced into contact with a sliding surface of a pivoting lever 31 that forms part of the safety mechanism 30. Alternatively, the sudden trip transmission device 20 may consist of any other transmission device placed between the start button 14 and circuit breaker-motor start device 16, and capable of being in a normal active state and a safety inactive state.

The lever 31 is approximately T-shaped, the end 32*a* of the T-leg 32 pivoting about an axis X3 parallel to the X1, X2 axes, and at one end of the T-flange 33 there is the sliding contact surface 34 for the toggle lever elbow, and at the other end there is the contact surface 35, normally applied in contact with a stop 41 formed on a pivoting lever 40. A weak return spring 36, for example a kickover spring (see FIGS. 2 to 8) acts on the lever 31 tending to push the surface 34 into contact with the toggle lever elbow 25. The lever 40 is placed between the emergency stop button 15 and the circuit breaker-motor stop device 17, to pivot about an axis Y2 parallel to or coincident with the Y1 axis; it cooperates with the mobile part 15*a* of the button 15 through a thrust contact 42 and with the device 17 by a finger 43. A return spring 44 may also be associated with the lever 24 used to activate the start button.

Operation of the device shown will be described with reference to FIGS. 3 to 8.

When the emergency stop button 15 is at rest and the operator presses the start button 14 (see FIG. 3), the mobile element of this start button drives the toggle lever 21, the elbow 25 of which slides on the surface 34 of the lever 31. Since the button 15 is at rest, the lever 40 is in the up position (see FIG. 4) and holds the lever 31 in place by its stop 41. Since the surface 34 cannot move, the toggle lever does not deform and forces the lever 24 to pivot to put the start device 16 into the active position. At the same time and under the effect of the circuit breaker-motor internal lock, the stop device 17 is forced into its out position, close to the finger 43 on the lever 40. When the button 14 is released, the operator allows it to return up under the effect of an internal spring and the button returns to its position shown in dashed lines in FIG. 3, and the various elements of devices 20, 30 occupy the positions shown in FIG. 5. When the operator presses the emergency stop button 15, the button goes down and presses through lever 42 on the circuit breaker-motor stop device 17, stopping the circuit breaker-motor (see FIG. 7). Furthermore, the lever stop 41 goes down and then allows the contact surface 35 on the lever 31 to move and therefore allows the lever 31 to pivot. At the same time, the circuit breaker-motor start device 16 is moved into the out position by the internal lock on the circuit breaker-motor. If the operator then accidentally presses the start button 14 (FIG. 6), the toggle lever is folded as soon as lever 24 comes into contact with the device 16, since the elbow 25 can pivot the lever 31, which is then released, in the clockwise direction (see FIG. 8), stretching the weak spring 36. The various elements of devices 20, 30 return to their initial position when the operator releases the pressure on start button 14 (see FIG. 5).

We claim:

1. A manually actuated device housed in a casing and fitted with a start control device and a stop control device with alternating movements, the manually actuated device, comprising:

a push type start button having a first axis;

an emergency stop button having a second axis parallel to said first axis of said start button, said start button and said stop button being associated with a surface of the casing and cooperating with said start control device and said stop control device, respectively;

a disengageable transmission device connected between the start button and the start control device, said disengageable transmission device having one of a normal state in which a pulse applied to the start button is transmitted to the start control device or a safety state in which the pulse is not transmitted to the start control device; and a safety mechanism connected between the stop button and the start control device so as to set the disengageable transmission device in said safety state.

2. The device according to claim 1, wherein said safety mechanism comprises a safety lever pivoting about an axis parallel to said first axis of said start button and said second axis of said stop button, said safety lever being operated by the stop button and forming a removable stop for the disengageable transmission device.

3. The device according to claim 2, wherein the disengageable transmission device comprises a toggle lever having a first end, a second end, and an elbow, said first end cooperating with said start button, said second end cooperating with said start control device, and said elbow sliding into contact with said safety lever.

4. The device according to claim 2, further comprising:

an intermediate lever between the stop button and the stop control device pivoting about a third axis perpendicular to said second axis of said stop button, and forming a removable stop for the safety lever, said safety lever being operated by said stop button through said intermediate lever.

5. The device according to claim 2, further comprising:

a spring pressing said safety lever towards said disengageable transmission device.

6. An actuation device, comprising:

a pushable start button;

a pushable stop button;

a disengageable transmission device connected between a starting mechanism and the start button, said disengageable transmission device having a first state in which a pulse applied to the start button is transmitted to the starting mechanism and a second state in which the pulse is not transmitted to the starting mechanism; and a safety mechanism connected between the stop button and the starting mechanism so as to set the disengageable transmission device in said second state.

7. The device according to claim 6, wherein a first axis of said start button is substantially parallel to a second axis of said stop button.

8. The device according to claim 6, wherein said safety mechanism comprises a moveable member, said moveable member being fixed when said stop button is not activated so said pulse applied to said start button activates the starting mechanism, and said moveable member being moveable when said stop button is activated so said pulse applied to said start button does not activate the starting mechanism.

9. The device according to claim 6, wherein said disengageable transmission device comprises a toggle lever having a first end, a second end, and an elbow, said first end cooperating with said start button, said second end cooperating with said starting mechanism, and said elbow sliding into contact with said safety mechanism.

10. The device according to claim 6, further comprising:

a lever between said stop button and a stopping mechanism, said safety mechanism being operated by said stop button through said lever.

* * * * *